US006969261B2

(12) United States Patent
Harris et al.

(10) Patent No.: US 6,969,261 B2
(45) Date of Patent: Nov. 29, 2005

(54) ELECTRICAL CONNECTOR

(75) Inventors: Shaun L. Harris, McKinney, TX (US); Gary Williams, Rowlett, TX (US); Paul Wirtzberger, Greenville, TX (US); Eric Peterson, McKinney, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 64 days.

(21) Appl. No.: 10/632,422

(22) Filed: Aug. 1, 2003

(65) Prior Publication Data

US 2005/0026463 A1 Feb. 3, 2005

(51) Int. Cl.[7] ..... H01R 12/00
(52) U.S. Cl. ..... 439/65; 439/660
(58) Field of Search ..... 439/65, 607, 608, 439/660, 4

(56) References Cited

U.S. PATENT DOCUMENTS

| | | | | |
|---|---|---|---|---|
| 4,179,171 | A | | 12/1979 | Shannon |
| 4,572,604 | A | | 2/1986 | Ammon et al. |
| 4,611,877 | A | | 9/1986 | Ellis |
| 5,224,866 | A | | 7/1993 | Nakamura et al. |
| 5,227,953 | A | | 7/1993 | Lindberg et al. |
| 5,403,202 | A | | 4/1995 | Roehling |
| 5,572,400 | A | | 11/1996 | Roesner et al. |
| 5,599,192 | A | * | 2/1997 | Olson ..... 439/65 |
| 5,674,078 | A | | 10/1997 | Davis et al. |
| 5,715,146 | A | | 2/1998 | Hoppal |
| 5,857,866 | A | | 1/1999 | Felps |
| 5,944,563 | A | | 8/1999 | Nagafuji |
| 6,006,980 | A | | 12/1999 | Lacourse et al. |
| 6,010,365 | A | | 1/2000 | Wu et al. |
| 6,053,776 | A | | 4/2000 | Bricaud et al. |
| 6,120,328 | A | | 9/2000 | Bricaud et al. |
| 6,165,018 | A | * | 12/2000 | Arnett et al. ..... 439/620 |
| 6,168,477 | B1 | | 1/2001 | Shih et al. |
| 6,224,405 | B1 | | 5/2001 | Eland |
| 6,276,942 | B1 | | 8/2001 | Hsiao |
| 6,315,584 | B1 | | 11/2001 | Greenside et al. |
| 6,368,121 | B1 | * | 4/2002 | Ueno et al. ..... 439/108 |
| 6,494,742 | B1 | | 12/2002 | Hu |
| 6,503,093 | B1 | | 1/2003 | Sakata et al. |
| 6,537,083 | B1 | | 3/2003 | Yatskov et al. |
| 6,537,086 | B1 | | 3/2003 | MacMullin |
| 6,537,087 | B2 | | 3/2003 | McNamara et al. |

OTHER PUBLICATIONS

"Elcon MINIPAK High–density Power Connectors," [on-line] Retrieved from: http://www.elconproducts.com/products/minipak/mipk_main–en.html 4 pages.

* cited by examiner

*Primary Examiner*—Briggitte R. Hammond
(74) *Attorney, Agent, or Firm*—Jody C. Bishop

(57) ABSTRACT

An electrical connector assembly for electrically coupling two components, such as two circuit boards, comprises a socket coupled to a first component and a blade coupled to a second component. The socket includes at least a first and a second conductive engagement member arranged on opposite sides of a spatial gap. The blade includes at least a first and a second conductive pad arranged on opposite sides of an insulator. The blade has a width complementary to the socket's spatial gap such that when inserted into the spatial gap the blade's first conductive pad forms an electrical contact with the socket's first conductive engagement member and the blade's second conductive pad forms an electrical contact with the socket's second conductive engagement member. The blade comprises first and second connector mechanisms that are arranged off-set from each other for electrically coupling the first and second conductive pads, respectively, to the second component.

26 Claims, 8 Drawing Sheets

ELECTRICAL CONNECTOR

BACKGROUND

Various types of electrical connectors are known in the art. In general, electrical connectors enable two components to be electrically coupled together. Electrical connectors may be used, for example, to electrically couple two circuit boards together. As is known in the art, size constraints are often placed on electrical connectors of the type used with printed circuit boards as relatively little space may be available on the circuit board for implementing such connectors. Further, it is often desirable for such connectors to possess good electrical characteristics, such as being capable of providing relatively high-power connections and/or provide relatively low inductance. Further, it is typically desirable for the connectors to be mechanically robust to enable a secure electrical connection between the circuit boards coupled by the connectors to ensure that electrical signals (e.g., data signals and/or electrical power supply) are properly communicated between the boards via the connectors.

One type of electrical connector used for coupling circuit boards is known in the art as a pin and socket connector. With a pin and socket connector, pins that are coupled to one component, such as a first circuit board, are inserted into sockets that are coupled to another component, such as a second circuit board, to form an electrical connection between the two components. A further example of an electrical connector that may be used for coupling circuit boards includes the Crown Edge Connector available from Elcon Power Connector Products Group of Tyco Electronics.

SUMMARY

According to at least one embodiment disclosed herein, an electrical connector assembly for electrically coupling two components is provided. The electrical connector assembly comprises a socket coupled to a first component, the socket having at least one segment that includes at least a first conductive engagement member arranged on a first side of a spatial gap and at least a second conductive engagement member arranged on an opposite side of the spatial gap, the second conductive engagement member being electrically isolated from the first conductive engagement member. The electrical connector assembly further comprises a blade coupled to a second component, the blade having at least one segment that includes at least a first conductive pad arranged on a first side of an insulator and at least a second conductive pad arranged on an opposite side of the insulator. The blade has a width complementary to the spatial gap of the socket such that when the blade is inserted into the spatial gap the first conductive pad of the blade forms an electrical contact with the first conductive engagement member of the socket and the second conductive pad of the blade forms an electrical contact with the second conductive engagement member of the socket. The first and second conductive pads of the blade are electrically isolated from each other. Also, the blade comprises first connector mechanisms for electrically coupling the first conductive pad to the second component and second connector mechanisms for electrically coupling the second conductive pad to the second component, wherein the first and second connector mechanisms are off-set from each other.

According to at least one embodiment, a system is provided that comprises a power supply board, and a circuit board comprising components to be powered at least partially by the power supply board. The system further comprises an electrical connector for electrically coupling the power supply board with the circuit board for supplying power from the power supply board to the circuit board via such electrical connector. The electrical connector comprises a socket coupled to one of the power supply board and the circuit board, the socket having at least one segment that includes at least a first conductive engagement member arranged on a first side of a spatial gap and at least a second conductive engagement member arranged on an opposite side of the spatial gap. The second conductive engagement member is electrically isolated from the first conductive engagement member. The electrical connector further comprises a blade coupled to the other of the power supply board and the circuit board, the blade having at least one segment that includes at least a first conductive pad arranged on a first side of an insulator and at least a second conductive pad arranged on an opposite side of the insulator. The blade has a width complementary to the spatial gap of the socket such that when the blade is inserted into the spatial gap the first conductive pad of the blade forms an electrical contact with the first conductive engagement member of the socket and the second conductive pad of the blade forms an electrical contact with the second conductive engagement member of the socket. The first and second conductive pads of the blade are electrically isolated from each other. The power supply board supplies electrical power to the circuit board via the electrical connector by conducting electrical signals of one polarity via the electrical contact between the first conductive engagement member of the socket and the first conductive pad of the blade and by conducting electrical signals of a polarity opposite the one polarity via the electrical contact between the second conductive engagement member of the socket and the second conductive pad of the blade.

According to at least one embodiment, a method of electrically coupling two circuit boards is provided. The method comprises inserting a blade that is coupled to a first circuit board within a spatial gap of a socket that is coupled to a second circuit board such that a first conductive pad and a second conductive pad of the blade that are arranged directly opposite each other on opposing sides of an insulator and that are electrically isolated from each other engage at least a first conductive member and a second conductive member, respectively, of the socket that are arranged on opposite sides of the spatial gap of the socket and that are electrically isolated from each other. The method further comprises conducting electrical signals of one polarity from one of the first and second circuit boards to the other of the first and second circuit boards via the engagement of the first conductive pad and the first conductive member, and conducting electrical signals of a polarity opposite the one polarity from one of the first and second circuit boards to the other of the first and second circuit boards via the engagement of the second conductive pad and the second conductive member.

DETAILED DESCRIPTION

Figure 1A:
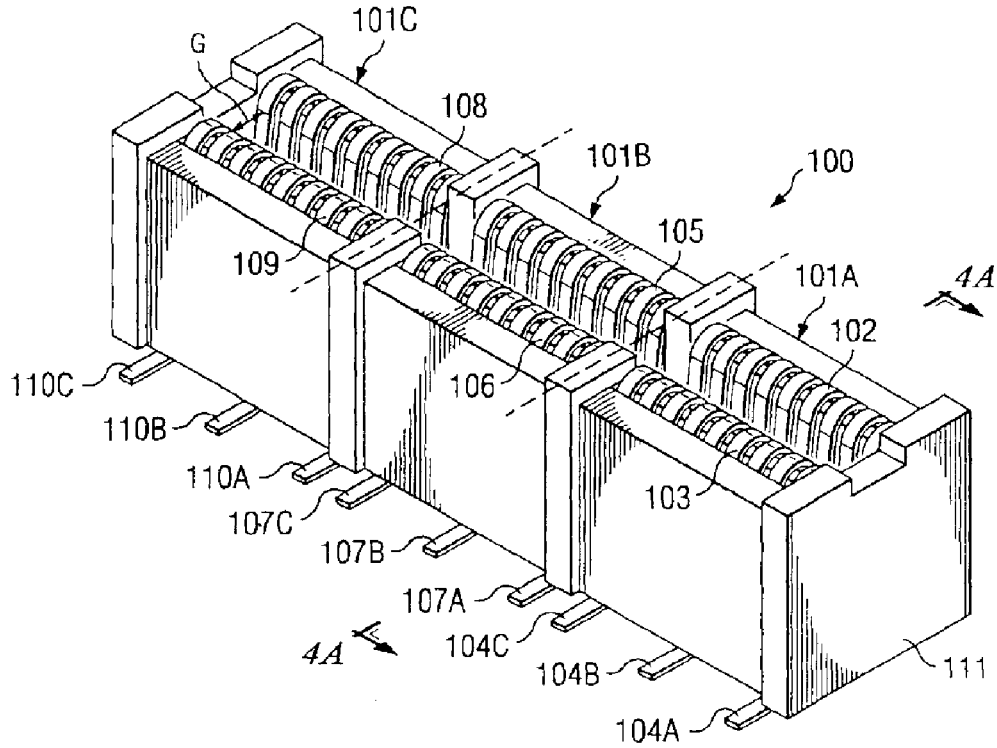
FIGS. 1A–1B show a first mating portion of an embodiment of an electrical connector.

Various embodiments of an electrical connector disclosed herein are now described with reference to the above figures, wherein like reference numerals represent like parts throughout the several views. In many instances, an electrical connector is desired that has a relatively small footprint. For example, an electrical connector may be desired for coupling two circuit boards together, wherein such connector does not require a large area of the circuit boards for its implementation. Further, an electrical connector may be needed that has sufficient electrical properties to support the type of transmission of electrical signals desired between the two circuit boards. For instance, it may be desirable for the electrical connector to be capable of supporting transmission of relatively high current and/or provide relatively low inductance. As an example, the electrical connector may be used for coupling a power board to a circuit board, wherein power is supplied from the power board to the circuit board via the electrical connector for powering components of the circuit board. In such an implementation, it is desirable that the electrical connector be suitable for supporting the transmission of power from the power board to the circuit board.

Further still, an electrical connector may be desired that provides "Z-axis" compliance. For example, the exact position in space of the two boards to be coupled relative to each other may not be dictated by the electrical connector, but instead the relative position of the boards may be determined by other mechanisms (such as support structures, frames, etc.). The relative position of the boards to be coupled may not be specifically defined, but may vary to some degree. For instance, mechanisms such as support structures may vary from implementation to implementation within an acceptable tolerance, thus resulting in the relative position of the two boards to be coupled varying over an acceptable range of positions. More specifically, the distance between the two boards to be coupled (referred to herein as the "Z-axis") may vary, wherein in certain implementations the two boards may be arranged at a particular distance to each other and in other implementations the two boards may be arranged at a different distance relative to each other. Thus, an electrical connector may be desired that provides Z-axis compliance by enabling the boards to be electrically coupled over a range of distances between the boards. That is, a target position for the boards may be one at which the boards are arranged with a distance "X" therebetween, but the system in which the boards are implemented may dictate (e.g., due to structural mechanisms, etc.) that a tolerance of plus/minus "D" distance from such target position be permitted. Thus, an electrical connector may be needed for coupling the boards that enables a proper electrical connection to be achieved between the boards for any relative positioning of the boards within the range X−D and X+D. This total range of values X−D through X+D is commonly referred to as the "Wipe" of the connector.

Embodiments of an electrical connector described further herein provide Z-axis compliance. For example, in certain embodiments an electrical connector may be used for coupling two circuit boards together, wherein such connector enables an electrical connection to be achieved between the two circuit boards over a range of distance values between the two circuit boards. As an example, in one implementation described herein, the boards have a target distance "X" of 7.1 millimeters (mm) therebetween when coupled together, but the electrical connector utilized for coupling the boards allows for a variance "D" of 30 mil (or 7.62 micrometers ($\mu$m)) such that the connector has a Wipe that covers at least 60 mil (or 15.24 $\mu$m). Of course, other connectors may be implemented in accordance with the teachings herein to provide for various other desired target distances and Wipes.

Further, certain embodiments of an electrical connector have desirable electrical characteristics. For instance, the electrical connector of certain embodiments is capable of supporting a relatively high current, as may be needed, for example, in supplying power from one board to another board via such electrical connector. Further, the electrical connector of certain embodiments may advantageously have relatively low inductance. Further still, in certain embodiments of an electrical connector the connector has a relatively small size, wherein a relatively small footprint may be used for implementing the electrical connector on the circuit boards.

Further, certain embodiments provide a blade and socket connector that enables electrical signals of opposing polarities to be conducted on opposite sides of the blade. For instance, the blade may comprise at least two conductive pads that are arranged on opposing sides of an insulator (e.g., directly across from each other), and the conductive pads on opposing sides of the insulator are electrically isolated such that one of the pads may be used for conducting electrical signals of one polarity and the other pad may be used for conducting electrical signals having an opposite polarity. Such opposing blades may, for instance, allow for a smaller distance between opposing currents. As is well-known, the closer the opposing currents (i.e., the closer the blade's conductive pads arranged on opposing sides of the insulator) the smaller (or lower) the inductance, which may be desirable.

Figure 1B:
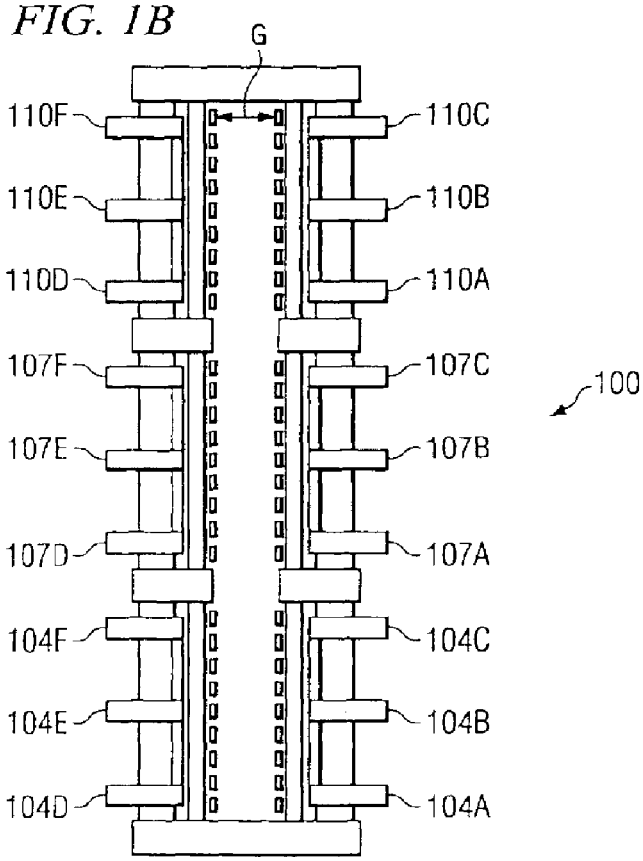

Turning to FIGS. 1A–1B, a first portion of an embodiment of a connector is shown. This first portion 100 (which may be referred to as a "socket" portion or "mating portion") may, for example, be coupled (e.g., soldered, press-fit, crimp, etc.) to a first circuit board, and such first portion 100 may be used to electrically couple to a second portion (or "blade portion") of a second circuit board, such as the example blade portion 200 described below with FIGS. 2A–2C. FIG. 1A shows an isometric view of the example socket portion 100 from the top, showing the top, front, and left sides thereof. FIG. 1B shows the bottom of socket portion 100.

The example socket portion 100 comprises structural casing 111 (e.g., of plastic or other substantially non-conductive material). This example socket portion 100 further comprises segments (or "contact pairs") 101A, 101B, and 101C arranged within casing 111, which each include engagement members for electrically engaging a conductive member (or "pad") of blade 200. More specifically, in this example, contact pair 101A comprises engagement members, such as members 102 and 103, that are electrically isolated from each other and are arranged on opposing sides of a gap "G" therebetween. Each of the engagement members are of a suitable material for conducting electrical signals, such as gold, copper, etc. As discussed further in conjunction with FIG. 3 below, blade 200 of FIGS. 2A–2C may be inserted into the gap G of socket 100 such that the engagement members (e.g., 102, 103, etc.) of socket 100 electrically engage the electrical engagement members or "pads" (e.g., pads 202, 204, 206, 209, 211, and 213) of blade 200, thereby forming an electrical connection.

As with contact pair 101A, contact pair 101B comprises engagement members, such as members 105 and 106, that are electrically isolated from each other and are arranged on opposing sides of gap G therebetween, and contact pair 101C also comprises engagement members, such as members 108 and 109, that are electrically isolated from each other and are arranged on opposing sides of gap G therebetween. As shown, each contact pair may comprise a plurality of engagement members (or "tines") arranged on each side of gap G. As discussed with FIGS. 7A–7B below, if two pieces of metal are forced together, there is generally only one dependable repeatable contact point. Implementing multiple tines within each contact pair creates multiple contact points, and thus may enable a better electrical contact to be achieved between the socket's contact pairs and the blade. In alternative embodiments a single tine may be implemented on each side of gap G for each contact pair.

As shown more clearly in FIG. 1B, board connector mechanisms 104A–104F, 107A–107F, and 110A–110F are included, which enable socket 100 to be securely coupled to a first circuit board. More specifically, in this example such board connector mechanisms 104A–104F, 107A–107F, and 110A–110F each comprise a pin that is arranged for surface mounting (e.g., via a simple surface mount soldering process) to a first circuit board. Of course, in other implementations of socket 100 any suitable connector mechanism for electrically securing socket 100 to a first circuit board may be implemented, including without limitation press-fit or pin and via solder process.

In the example implementation of FIGS. 1A–1B, pins 104A–104C are electrically coupled to the engagement members of contact pair 101A that are arranged on one side of gap G, such as engagement member 103, and pins 104D–104F are electrically coupled to the engagement members of contact pair 101A that are arranged on the opposite side of gap G, such as engagement member 102. Thus, pins 104A–104C provide electrical signals (e.g., power) to (and/or receive electrical signals from) the engagement members arranged on one side of gap G, such as engagement member 103, while pins 104D–104F provide electrical signals (e.g., power) to (and/or receive electrical signals from) the engagement members arranged on the opposite side of gap G, such as engagement member 102. That is, pins 104A–104C may be electrically coupled to a circuit board to conduct electrical signals (e.g., power) from components on the board to the engagement members of contact pair 101A of socket 100 that are arranged on one side of gap G, such as engagement member 103 (and vice-versa), and pins 104D–104F may be electrically coupled to the circuit board to conduct electrical signals from components on the board to the engagement members of contact pair 101A of socket 100 that are arranged on the opposite side of gap G, such as engagement member 102 (and vice-versa).

Similarly, pins 107A–107C are electrically coupled to the engagement members of contact pair 101B that are arranged on one side of gap G, such as engagement member 106, and pins 107D–107F are electrically coupled to the engagement members of contact pair 101B that are arranged on the opposite side of gap G, such as engagement member 105. That is, pins 107A–107C may be electrically coupled to a circuit board to conduct electrical signals (e.g., power) from components on the board to the engagement members of contact pair 101B of socket 100 that are arranged on one side of gap G, such as engagement member 106 (and vice-versa), and pins 107D–107F may be electrically coupled to the circuit board to conduct electrical signals from components on the board to the engagement members of contact pair 101B of socket 100 that are arranged on the opposite side of gap G, such as engagement member 105 (and vice-versa).

Also, pins 110A–110C are electrically coupled to the engagement members of contact pair 101C that are arranged on one side of gap G, such as engagement member 109, and pins 110D–110F are electrically coupled to the engagement members of contact pair 101C that are arranged on the opposite side of gap G, such as engagement member 108. That is, pins 110A–110C may be electrically coupled to a circuit board to conduct electrical signals (e.g., power) from components on the board to the engagement members of contact pair 101C of socket 100 that are arranged on one side of gap G, such as engagement member 109 (and vice-versa), and pins 110D–110F may be electrically coupled to the circuit board to conduct electrical signals from components on the board to the engagement members of contact pair 101C of socket 100 that are arranged on the opposite side of gap G, such as engagement member 108 (and vice-versa).

Implementing multiple pins for each side of a contact pair (e.g., pins 104A–104C for providing electrical signals to the engagement members on one side of contact pair 101A) for coupling the socket to a circuit board improves the manufacturability of the connector, and such multiple pins disperse the current density in the mating circuit board. Since the individual pins are small and have a smaller mass than the total mass of the engagement members (or "tines") of their respective side of the contact pair, they can be heated to solder melting temperature quicker than a larger piece of metal. A larger piece of metal requires longer dwell time in the wave solder machine. The smaller solder piece translates to lower imperfections in production.

In certain embodiments, pins 104A–104F, 107A–107F, and 110A–110F may each form part of an engagement member of socket 100. For instance, engagement member 103 may extend to provide pin 104A, such that pin 104A is actually formed from part of engagement member 103. That is, the conducting material used to form the engagement members may be of a suitable length to extend below structural casing 111, and, as in this example, may be bent to form pins 104A–104F, 107A–107F, and 110A–110F for being surface mounted to a circuit board. As described further below with FIG. 4A, the engagement members (or "tines") of socket 100 may be implemented as fish-hook type members, and pins 104A–104F, 107A–107F, and 110A–110F may be part of those members that are provided for securing socket 100 to a first circuit board.

Thus, pins 104A–104F, 107A–107F, and 110A–110F may be electrically secured (e.g., via surface mounting) to a first circuit board to receive electrical signals from (and/or provide electrical signals to) the first circuit board. For example, as discussed below with FIGS. 11A and 11B, in certain applications socket 100 may be coupled to a power board, and blade 200 of FIGS. 2A–2C may be coupled to a processor board, whereby socket 100 electrically couples to blade 200 (via contact between the engagement members of socket 100 and the pads of blade 200) such that power may be provided from the power board to the processor board via such coupling of socket 100 to blade 200.

It should be recognized that segments 101A–101C are electrically isolated from each other. For instance, while pins 104A–104C provide signals to the engagement members (or tines) of contact pair 101A arranged on one side of gap G and pins 104A–104C provide signals to the engagement members (or tines) of contact pair 101A arranged on the opposite side of gap G, the engagement members of contact pair 101A are electrically isolated from the engagement members of contact pair 101B. Thus, the signals provided on pins 104A–104F are electrically isolated from the signals provided on pins 107A–107F in this example. Of course, while an example socket portion that comprises three electrically isolated contact pairs 101A–101C is shown in FIG. 1, other embodiments of socket 100 may comprise any number of such contact pairs. For instance, in certain embodiments, socket 100 may comprise only contact pair 101A, while in other embodiments socket 100 may comprise more than three contact pairs that are electrically isolated from each other.

Figure 2A:
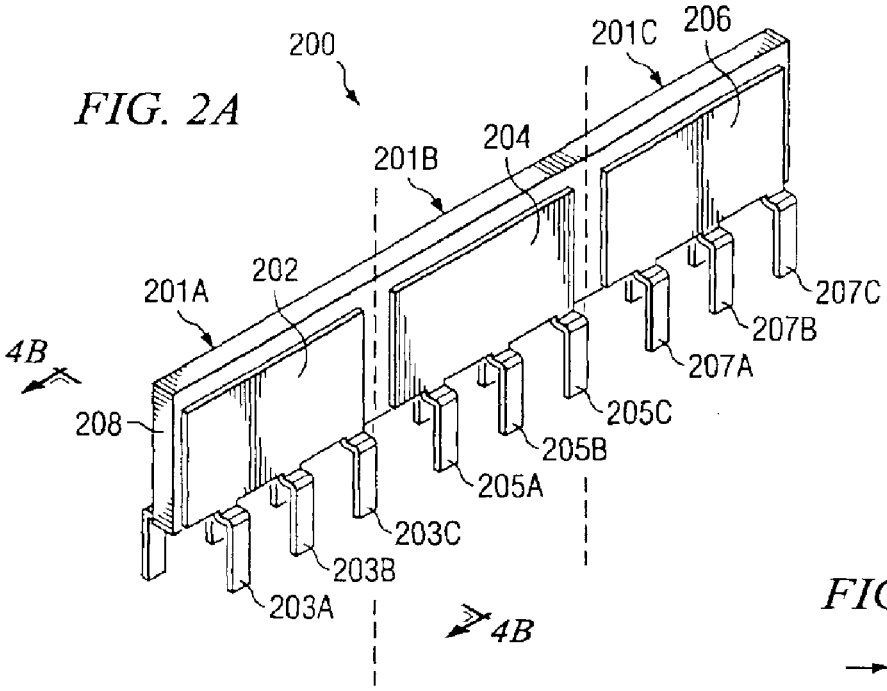
FIGS. 2A–2C show a second mating portion that is complementary to the first mating portion of FIGS. 1A–1B of an embodiment of an electrical connector.
Figure 2B:
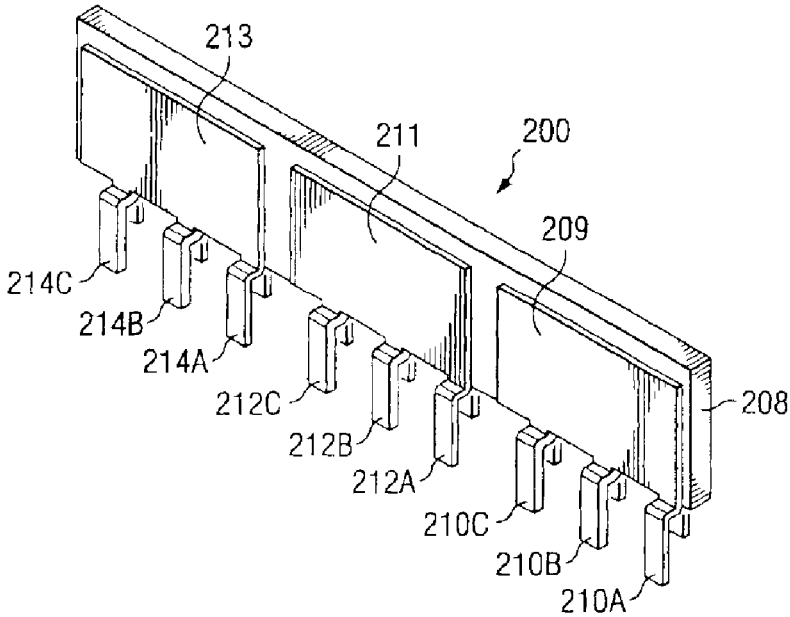
Figure 2C:
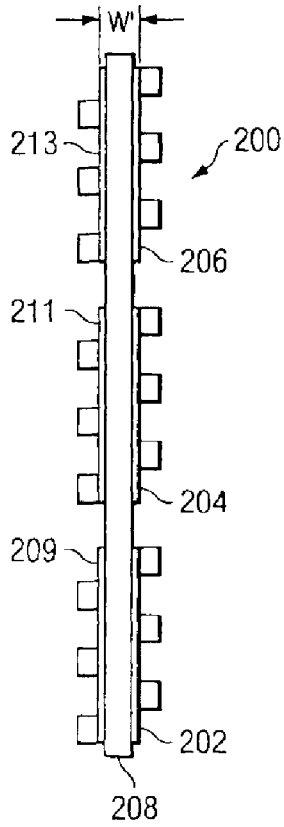

Turning to FIGS. 2A–2C, a second mating portion (which may be referred to as a "blade" portion) of an embodiment of a connector is shown. This blade portion 200 may, for example, be coupled to a second circuit board, and such blade portion 200 may be used to electrically couple to a complementary mating portion, such as the example socket portion 100 of FIGS. 1A–1B, that is coupled to a first circuit board, thereby electrically coupling the first and second circuit boards together. FIG. 2A shows an isometric view of the example blade 200 from the right, showing the top, front, and right sides thereof. FIG. 2B shows an isometric view of the example blade 200 from the left, showing the top, front, and left sides thereof. FIG. 2C shows the top of blade 200.

With reference to FIGS. 2A–2C, this example embodiment of blade 200 includes segments (or "contact pairs") 201A, 201B, and 201C. Each segment comprises a conductive member (which may be referred to herein as an engagement member or "pad") arranged on each side of an insulator (e.g., plastic or other non-conductive material) 208. For instance, segment 201A comprises pad 202 arranged on one side (e.g., the right side) of insulator 208 (as shown in FIG. 2A) and pad 209 arranged on the opposite side (e.g., the left side) of insulator 208 (as shown in FIG. 2B). Segment 201B comprises pad 204 arranged on one side (e.g., the right side) of insulator 208 (as shown in FIG. 2A) and pad 211 arranged on the opposite side (e.g., the left side) of insulator 208 (as shown in FIG. 2B). And, segment 201C comprises pad 206 arranged on one side (e.g., the right side) of insulator 208 (as shown in FIG. 2A) and pad 213 arranged on the opposite side (e.g., the left side) of insulator 208 (as shown in FIG. 2B). Thus, pads 202, 204, and 206 are arranged on one side (e.g., the right side) of insulator 208, and such pads 202, 204, and 206 are electrically isolated from each other as shown (e.g., via a non-conductive separation area or "spacing" between each pad). Pads 209, 211, and 213 are arranged on the opposite side (e.g., the left side) of insulator 208, and such pads 209, 211, and 213 are electrically isolated from each other as shown (e.g., via a non-conductive separation area or "spacing" between each pad). In this example embodiment, pads 202, 204, and 206 are arranged directly opposite pads 209, 211, and 213, respectively. Each of pads 202, 204, 206, 209, 211, and 213 are of a suitable material for conducting electrical signals, such as gold, copper, etc.

Blade 200 also includes board connector mechanisms for securely coupling such blade 200 to a circuit board. In the example implementation of FIGS. 2A–2C, pins are provided that may be used to secure blade 200 to a circuit board via through-hole pin soldering. More specifically, pins 203A–203C (collectively "pins 203") are electrically coupled to pad 202 of segment 201A, and pins 210A–210C (collectively "pins 210") are electrically coupled to pad 209 of segment 201A. Thus, pins 203 provide electrical signals (e.g., power) to (and/or receive electrical signals from) pad 202, while pins 210 provide electrical signals (e.g., power) to (and/or receive electrical signals from) pad 209. That is, pins 203 may be electrically coupled to a circuit board to conduct electrical signals (e.g., power) from pad 202 to components on the board (and vice-versa), and pins 210 may be electrically coupled to the circuit board to conduct electrical signals from pad 209 to components on the board (and vice-versa).

Similarly, pins 205A–205C (collectively "pins 205") are electrically coupled to pad 204 of segment 201B, and pins 212A–212C (collectively "pins 212") are electrically coupled to pad 211 of segment 201B. That is, pins 205 may be electrically coupled to a circuit board to conduct electrical signals (e.g., power) from pad 204 to components on the board (and vice-versa), and pins 212 may be electrically coupled to the circuit board to conduct electrical signals from pad 211 to components on the board (and vice-versa).

Also, pins 207A–207C (collectively "pins 207") are electrically coupled to pad 206 of segment 201C, and pins 214A–214C (collectively "pins 214") are electrically coupled to pad 213 of segment 201C. That is, pins 207 may be electrically coupled to a circuit board to conduct electrical signals (e.g., power) from pad 206 to components on the board (and vice-versa), and pins 214 may be electrically coupled to the circuit board to conduct electrical signals from pad 213 to components on the board (and vice-versa).

For the same reasons mentioned for the pins of socket 100 above, multiple pins may be implemented for each side of a segment of blade 200 (e.g., pins 203A–203C for receiving electrical signals from pad 202 on one side of segment 201A) for coupling the blade to a circuit board. In certain implementations, fewer than (or more than) 3 pins may be provided for coupling a pad, such as pad 202, to a circuit board.

In certain embodiments, pins 203, 205, 207, 210, 212, and 214 may each form part of pads 202, 204, 206, 209, 211, and 213, respectively. For instance, the conducting material used to form pad 202 may be arranged such that pins 203 extend from pad 202. Pins 203, 205, 207, 210, 212, and 214 may be electrically secured (e.g., via through-hole soldering) to a circuit board to receive electrical signals from (and/or provide electrical signals to) the circuit board. It should be understood that while pins 203, 205, 207, 210, 212, and 214 are implemented as through-hole pins in this example (e.g., to enable through-hole soldering for mounting blade 200 to a circuit board), in alternative implementations, any other suitable mechanism for securing blade 200 to a circuit board may be utilized. For example, in certain embodiments pins 203, 205, 207, 210, 212, and 214 may be implemented for surface-mounting blade 200 to a circuit board.

It should be recognized that segments 201A–201C of blade 200 are electrically isolated from each other. For instance, pads 202, 204, and 206 arranged on one side of insulator 208 are electrically isolated from each other, and pads 209, 211, and 213 arranged on the other side of insulator 208 are electrically isolated from each other. Of course, while an example blade that comprises three electrically isolated segments 201A–201C is shown in FIGS. 2A–2C, other embodiments of blade 200 may comprise any number of such segments. For instance, in certain embodiments, blade 200 may comprise only segment 201A, while in other embodiments blade 200 may comprise more than three segments that are electrically isolated from each other.

As described further below in conjunction with FIG. 3, blade 200 comprises a width (shown as W' in FIG. 2C) that is complementary to mating component (or "socket") 100 of FIGS. 1A–1B. That is, blade 200 comprises a width such that when inserted into gap G of socket 100, the pads of blade 200 securely contact the engagement members (or tines) of socket 100 to enable conducting of electrical signals therebetween. In certain embodiments, the pins for securing blade 200 to a circuit board (i.e., pins 203, 205, 207, 210, 212, and 214 in this example) are arranged to enable a relatively narrow width (such as W' in the example of FIG. 2C), thus enabling a relatively narrow gap G of socket 100 to be implemented and allowing a relatively narrow footprint for arranging socket 100 on a first circuit board and for arranging blade 200 on a second circuit board. In the example of FIGS. 2A–2C, the pins of blade 200 are arranged in an "off-set" manner to enable a relatively small width W'. That is, as described further below in conjunction with FIGS. 5B–5C, the pins of blade 200 are arranged such that the pins on one side of insulator 208 are not directly across from the pins of on the opposite side of insulator 208 (but are instead off-set).

In certain embodiments, the pads on opposing sides of insulator 208 are used for communicating electrical signals of opposing polarity, as described further below in conjunction with FIG. 4B. For instance, in such an embodiment pad 202 of segment 201A may be implemented to communicate signals having positive polarity and pad 209 may be implemented to communicate signals having negative polarity. The potential benefits of such a blade implementation are described further below. Traditional blade-socket connectors do not enable signals of opposing polarities to be conducted on opposing sides of the blade but instead have a single-pole blade implementation. For instance, the Minipak Connector available from Elcon Power Connector Products Group of Tyco Electronics does not have isolated pads on opposing sides of the blade. As described further herein, certain embodiments of blade 200 have pads that are electrically isolated, wherein the separation distance between the pads may be reduced thereby reducing the inductance and the volume required for implementing the connector.

Figure 3:
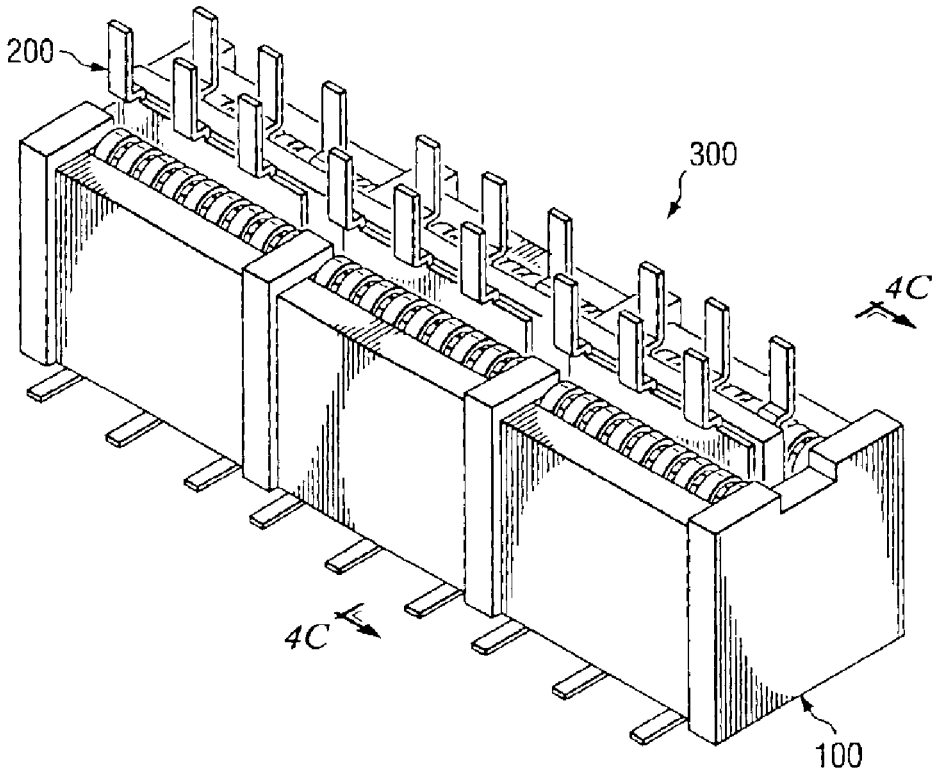
FIG. 3 shows an example of the first mating component of FIGS. 1A–1B mated with the second mating component of FIGS. 2A–2C.

Turning now to FIG. 3, an example of the two mating components of FIGS. 1A–1B and 2A–2C are shown mated (i.e., coupled together). Thus, FIG. 3 shows a resulting electrical connector 300 that is formed when the two mating components 100 and 200 are coupled together. As shown in FIG. 3, the pads of blade 200 are inserted into the gap G of socket 100 such that the pads of blade 200 each contact an engagement member of socket 100 to enable conducting of electrical signals therebetween. More specifically, for a given segment of socket 100 and blade 200, a pad on one side of the blade's insulator 208 contacts an engagement member on one side of gap G of socket 100, and a pad on the opposite side of the blade's insulator 208 contacts an engagement member on the opposite side of gap G of socket 100. For instance, pad 202 of segment 201A of blade 200 contacts engagement member 102 (as well as other engagement members of segment 101A of socket 100 arranged on the same side of gap G as engagement member 102, in this example), and pad 209 of segment 201A of blade 200 contacts engagement member 103 (as well as other engagement members of segment 101A of socket 100 arranged on the same side of gap G as engagement member 103, in this example).

Figure 4A:
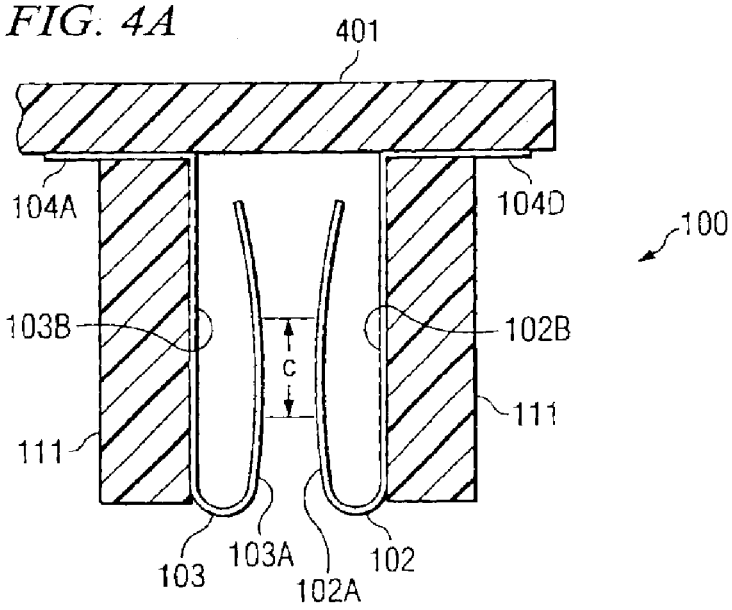
FIG. 4A shows a cross-section of the example first mating component of FIGS. 1A–1B.
Figure 4B:
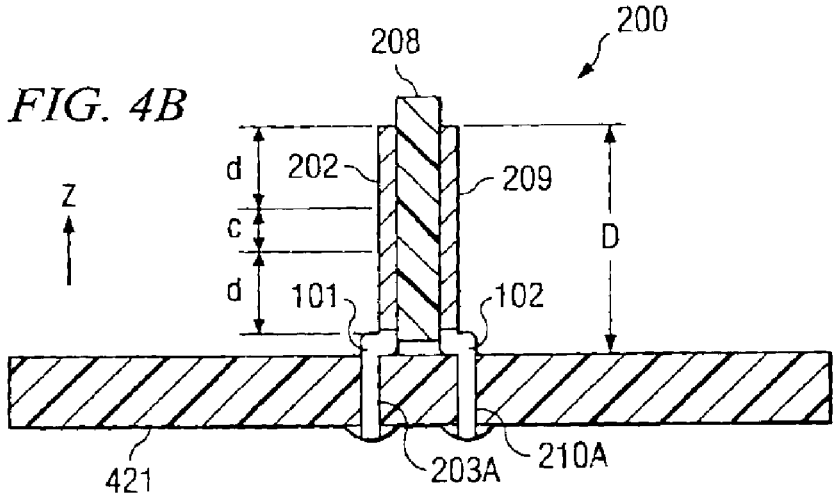
FIG. 4B shows a cross-section of the example second mating component of FIGS. 2A–2C.
Figure 4C:
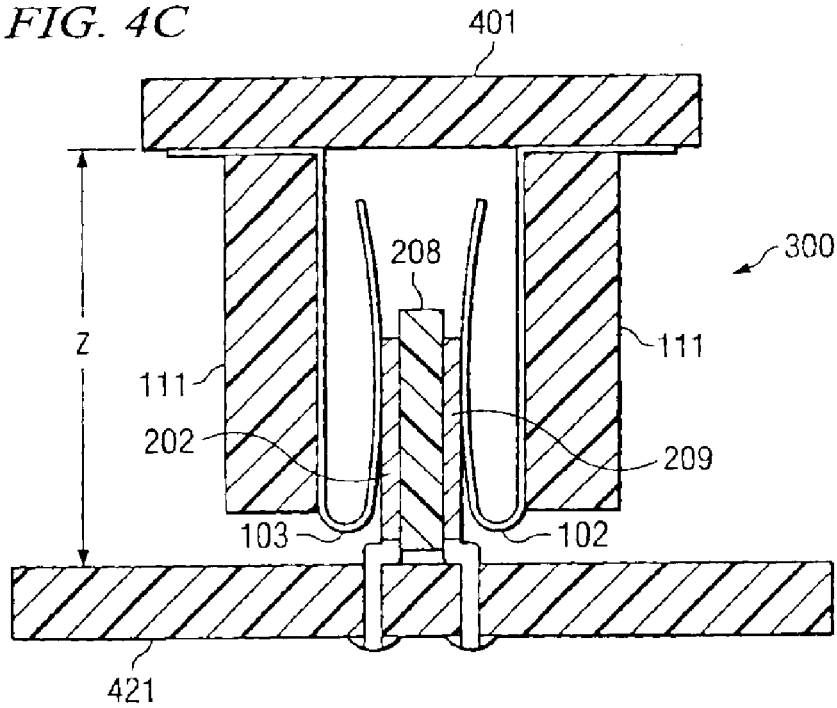
FIG. 4C shows a cross-section of the first mating component and second mating component mated together, as in FIG. 3.

Various features of an example embodiment of an electrical connector are now further described in conjunction with FIGS. 4A–4C. FIG. 4A shows a cross-section of the example first mating component 100 of FIGS. 1A–1B. FIG. 4B shows a cross-section of the example second mating component (or "blade") 200 of FIGS. 2A–2C. FIG. 4C shows a cross-section of the first mating component 100 and second mating component 200 mated together, as in FIG. 3.

As shown in FIG. 4A, first mating component (or "socket") 100 is secured to first circuit board 401 via surface mounting (e.g., surface soldering of pins 104A and 104D) in this example. In certain embodiments, the electrical engagement members of first mating component 100 are formed into a "fish-hook" manner. For instance, engagement members 102 and 103 are each shown in the cross-section of FIG. 4A as being disposed on opposing sides of gap G. Engagement members 102 and 103 each have a fish-hook arrangement with contact zones labeled "c". As shown in this example, engagement member 102 includes an engaging portion or "tine" 102A and a tine holder (or support) portion 102B. Similarly, engagement member 103 includes an engaging portion or "tine" 103A and a tine holder (or support) portion 103B. As shown in FIG. 4C, when socket 100 is coupled to blade 200 the surface of tine 102A engages the surface of pad 209 of blade 200, and the surface of tine 103A engages the surface of pad 202.

As discussed further with FIG. 4C below, the contact zones "c" of the tines enable a range of positions along the "Z-axis" at which the first mating component 100 and second mating component 200 may be arranged relative to each other and still provide an electrical coupling therebetween. While engagement members 102 and 103 have a fish-hook shape in this example, in other implementations they may have any suitable form that enables a suitable contact zone along which contact may be made with the pads of blade 200.

As shown in FIG. 4B, second mating component (or "blade") 200 is secured to a second circuit board 421 via through-hole soldering of pins 203A and 210A in this example. It should be recognized that while pins 203A and 210A appear to be arranged directly across from each other in the example cross-section of FIG. 4B, in certain embodiments those pins may be off-set such that they are not directly across from each other, as discussed further in conjunction with FIGS. 5B–5C below. Pads 202 and 209 of blade 200 are shown, which are arranged on opposite sides of insulator 208. In this example embodiment, pad 202 is implemented for conducting electrical signals of one polarity (e.g., positive (+) polarity) and pad 209 is implemented for conducting electrical signals of an opposite polarity (e.g., negative (–) polarity).

FIG. 4C shows a cross-section of the resulting electrical connector formed when first mating component 100 (of FIG. 4A) and second mating component or "blade" 200 (of FIG. 4B) are coupled. More specifically, the pads 202 and 209 of blade 200 are inserted into the gap G of first mating component 100 such that pad 202 contacts engagement member 103 and pad 209 contacts engagement member 102. Accordingly, the resulting electrical connector 300 electrically couples circuit board 401 with circuit board 421 such that electrical signals may be passed therebetween via connector 300.

This example embodiment advantageously enables "Z-axis compliance". That is, the "Z-axis" is shown in FIG. 4C as an axis that represents the distance between circuit boards 401 and 402. For instance, the Z-axis may comprise an axis that is perpendicular to the surfaces of both circuit boards 401 and 402. It should be recognized that in the embodiment of FIG. 4C blade 200 is inserted into first mating component 100 through movement of such blade 200 along the Z-axis. Accordingly, in certain embodiments, the Z-axis may correspond (or be parallel) to the insertion axis (i.e., the axis along which blade 200 moves for insertion into first mating component 100). In many applications, the specific distance that may be achievable between circuit boards 401 and 402 (along the Z-axis) may vary. For instance, structural (or other) mechanisms of the boards may dictate how closely the boards may be brought together. Further, such structural mechanisms may not be precise (e.g., due to manufacturing processes, etc.) as to the distance achievable between circuit boards 401 and 402, but instead the resulting distance may differ between different implementations. Thus, one system may be manufactured in which circuit boards 401 and 402 are arranged at a first distance relative to each other, and another system may be manufactured in which circuit boards 401 and 402 are arranged at a different distance relative to each other. It may be desirable for an electrical connector to be implemented that enables an electrical coupling to be achieved between the circuit boards over a range of different distances at which the boards may be arranged relative to each other.

For instance, structural mechanisms (not shown in FIG. 4C) may provide for circuit boards 401 and 402 to be brought together such that a distance of "X" plus/minus a tolerated amount of variance "d" is achieved between the boards. Thus, it may be desirable for an electrical connector that is used for forming an electrical connection between circuit boards 401 and 402 to have a desired amount of Z-axis compliance such that an electrical connection is achieved between boards 401 and 402 if they are arranged at any distance relative to each other within a given range of distances (e.g., the range of "X" plus/minus the tolerated amount of variance "d"). That is, circuit boards 401 and 402 can be arranged at any point along a range of points on the Z-axis and still be electrically connected.

A target contact zone "c" is shown for the blade 200 in FIG. 4B, with a tolerance of distance "d" on either side thereof. Thus, the total distance "D" along the Z-axis is available for making contact with the contact zone "c" of mating component 100 of FIG. 4A. In an example implementation of the connector, the target distance "X" be achieved between the two circuit boards when coupled together by the connector assembly 300 is 7.1 mm, and the connector allows for a tolerance distance "d" of 30 mil on each side of the target distance "X" such that the connector has a Wipe to cover at least 60 mil. Thus, this example implementation of the connector enables a relatively wide range of values at which the circuit boards may be positioned relative to each other (along the Z axis) and still provide a suitable electrical connection between the boards.

Figure 5A:
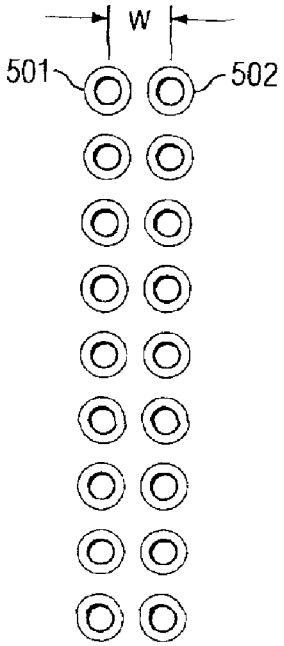
FIG. 5A (PRIOR ART)
FIG. 5A shows a traditional through-hole pin arrangement, in which various pins are arranged directly across from each other.
Figure 5B:
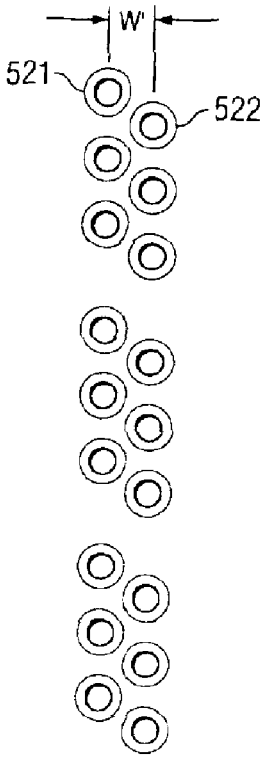
FIG. 5B shows an example through-hole pin arrangement of an embodiment of an electrical connector in which various holes are not arranged directly across from each other but are instead off-set from each other.
Figure 5C:
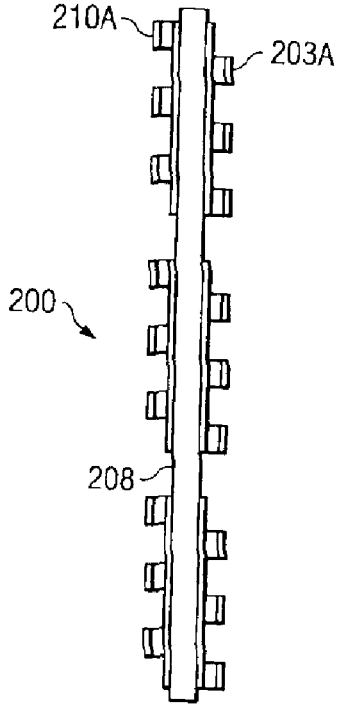
FIG. 5C shows an example off-set arrangement of pins implemented on the second mating component of FIGS. 2A–2C, wherein the pins are arranged for insertion into the hole arrangement of FIG. 5B.

Turning to FIGS. 5A–5C, an off-set pin arrangement that may be implemented for either one or both of the mating components of an embodiment of an electrical connector is described. FIG. 5A shows a traditional through-hole pin arrangement, in which various pins are arranged directly across from each other. More specifically, FIG. 5A shows a traditional layout for holes on a circuit board through which pins of a component may be inserted and soldered for coupling the component to the board. Again, the holes for receiving pins of one side of the component are arranged directly across from the holes for receiving pins of the opposite side of the component. For instance, hole 501 is arranged directly across from hole 502, thus resulting in a width W of the footprint for coupling the component to the circuit board.

FIG. 5B shows an example through-hole pin arrangement in which various holes on a circuit board are not arranged directly across from each other but are instead off-set from each other. More specifically, FIG. 5B shows an example layout for holes on a circuit board through which pins of a component may be inserted and soldered for coupling the component to the board. Again, the holes for receiving pins of one side of the component are not arranged directly across from the holes for receiving pins of the opposite side of the component. That is, each hole for receiving a pin of one side of a component is not arranged directly across from a hole for receiving a pin of the opposite side of the component, but rather the holes for receiving pins of one side of the component are off-set from the holes for receiving pins of the opposite side of the component. For instance, hole 521 is not arranged directly across from hole 522, but is instead off-set from such hole 522. Accordingly, by offsetting the holes for receiving pins of opposing sides of the component, the resulting width the footprint for coupling the component to the circuit board may be reduced below that required for traditional hole arrangements (such as that of FIG. 5A), thus enabling a narrower implementation of the component when desired. For instance, the arrangement of FIG. 5B enables a footprint having width W', which is narrower than the width W of the traditional footprint of FIG. 5A. For instance, in the example of FIG. 2C, the blade is preferably implemented having a width W' of no more than 3.5 mm. In certain embodiments the blade comprises a width W' of approximately 1.5 mm.

In certain embodiments, blade 200 is implemented to include pins arranged in an off-set manner for coupling to a circuit board in accordance with a footprint such as the example footprint of FIG. 5B. For instance, FIG. 5C shows an example off-set arrangement of the pins of blade 200 in which the pins are arranged such that no pin on one side of insulator 208 is arranged directly across from a pin on the other side of insulator 208. For instance, pin 210A arranged on one side of insulator 208 is off-set from pin 203A arranged on the opposite side of insulator 208. This example arrangement of pins in FIG. 5C may be coupled to a circuit board by through-hole coupling of the pins with the corresponding holes of FIG. 5B. For instance, pin 210A may couple through hole 521 and pin 203A may couple through hole 522 (wherein the top side of a circuit board is shown in FIG. 5B and blade 200 couples to the bottom side of such circuit board in this example).

It should be recognized that such an arrangement advantageously enables blade 200 to have a relatively narrow width W', which enhances its inductance. That is, a benefit of reduced width is reduced inductance L. As is well-known, inductance is generally governed by $L \approx (\mu_0 \mu_r h/w)l$, wherein L is inductance, w is the width of the blade's pad (e.g., the distance D shown in FIG. 4B), and h is the separation distance between the blade's pads. The closer the pads are to each other, the lower the inductance L. Also, the wider the pad the lower the inductance L. Providing a small inductance may be particularly desirable in an electrical connector that conducts relatively high power. For instance, the change in supply voltage (deltaV) is governed by deltaV=di/dt, where di/dt is the change in current over time. Suppose that in a first system a power board is coupled to a processor board via an electrical connector, whereby the power board supplies 100 A/$\mu$s di/dt. Now suppose that in a second system a power board is coupled to a processor board via an electrical connector, whereby the power board supplies 1000 A/$\mu$s. The second system has a 10 times increase in deltaV over that of the first system, and therefore it may be desirable to implement in the second system an electrical connector that provides a very small inductance L to reduce the associated deltaV.

An embodiment of an electrical connector has desirable electrical characteristics, including the ability to conduct relatively high power and having relatively low inductance. The electrical characteristics of an electrical connector in accordance with one embodiment are described in further detail below in conjunction with FIGS. 6A, 6B, 7A, 7B, 8, 9, and 10.

Figure 6A:
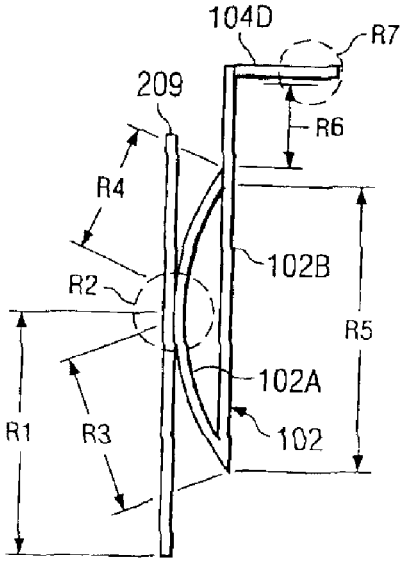
FIG. 6A shows the resistive components in the current path of a portion of the cross-section of the example connector of FIG. 4C.
Figure 6B:
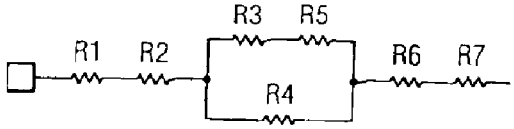
FIG. 6B shows a partial resistances circuit diagram corresponding to the portion of the connector shown in FIG. 6A.

FIG. 6A shows the resistive components in the current path of an embodiment of the electrical connector. More specifically, FIG. 6A shows a portion of the cross-section of FIG. 4C in which engagement member 102 of socket 100 is in contact with pad 209 of blade 200 with resistive components labeled $R_1$–$R_7$. $R_1$ represents the blade resistance, and $R_2$ represents the contact resistance. $R_3$ and $R_4$ represent tines 102A resistance, and $R_5$ and $R_6$ represent tines holder 102B resistance. $R_7$ represents soldered resistance (for the solder joint coupling engagement member 102 to its respective circuit board) and press-fit resistance. The DC resistance is found by partitioning the current path passing through the blade and socket contact. The DC resistance of the electrical connector can be calculated using $R=l/(\sigma A)$, where R is the DC resistance, $\sigma$ is the conductivity of the material, A is the cross-section area, and l is the length (along the current path). FIG. 6B shows a partial resistances circuit diagram corresponding to the portion of the connector shown in FIG. 6A.

The blade resistance $R_1$ is the resistance of the blade when mated in the socket from the entrance of the connector to the first contact with the tines. The value of the blade resistance depends on the following: blade geometry (length, width, and thickness), and blade material (the material's resistivity or conductivity). The contact resistance (or constriction resistance) $R_2$ refers to the contact resistance between the blade (and more specifically pad 209) and the tines (tine 102A), when fully mated. This resistance depends on the following factors: 1) effective interface (contact) area between the blade and socket, and 2) normal forces—the contact resistance is inversely proportional to the normal forces between the blade and the tines. The tines resistance $R_3$ and $R_4$ is dependent on the geometry of each tine, and can be calculated as $R=1/(\sigma A)$. The effective resistance is found by adding the tine resistances $R_3$ and $R_4$ in parallel. The tine holder resistance $R_5$ and $R_6$ may be found from its geometry and using the conductivity coefficient of its material (e.g., copper). The soldered resistance R7 is the resistance of the pins soldered to the board. This resistance may be considered negligible for simplicity. The press-fit resistance R7 depends on the following: 1) circuit board copper thickness, 2) number of contact tails, and 3) the press-fit force between the board and the soldered pins.

Figure 7A:
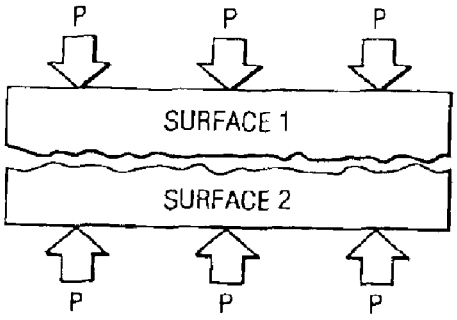
FIGS. 7A–7B show an example of two pieces of metal being forced together to illustrate the apparent versus effective contact area of the pieces of metal.

As mentioned above, each contact pair of socket 100 may comprise a plurality of engagement members (or "tines") arranged on each side of gap G. As shown in the example of FIG. 7A, if two pieces of metal are forced together, there is generally only one dependable repeatable contact point. More specifically, the example of FIG. 7A illustrates that the metals' surfaces are typically not perfectly smooth. For instance, two finishes that have been machined flat and then smoothed and polished with progressive grit compounds generally still have jabbed surfaces. Mating two polished surfaces still only mates a percentage of the overall surface. For tines, which have small contact areas, it is assumed that only a small percentage (or one point) is making contact.

Figure 7B:
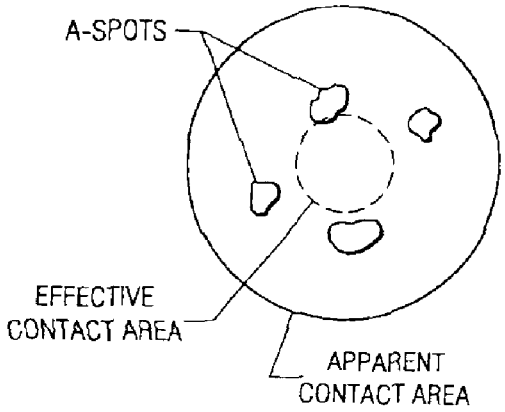

That is, when the surfaces of the metal are not molecularly smooth, the surfaces may have only one (or a few) dependably repeatable contact points. Implementing multiple tines within each contact pair creates multiple contact points, and thus may enable a better electrical contact to be achieved between the socket's contact pairs and the blade. For instance, as shown in FIG. 7B, the effective contact area between two pieces of metal that are forced together is generally less than the apparent contact area (i.e., the total area of the metal pieces that appear to be in contact). Rather, actual contact may occur at certain A-spots within the apparent contact area, wherein the total area of such A-spots corresponds to the effective contact area. Thus, in certain embodiments, multiple tines are implemented within each contact pair, whereby each tine comprises an effective contact area with the blade's pad that it is contacting, which may result in an overall increase in the effective contact area between the socket's tines and the blade's pad than might be achieved if the socket's engagement member and the blade's pad where each implemented as single pieces of metal.

It should be recognized that an embodiment of the electrical connector may be implemented with very low inductance. Measuring low inductance is a very challenging task. Special fixture and measuring equipment (network analyzer, spectrum analyzer, etc.) may be used in measuring the inductance accurately. Further, parasitic effects should be taken into consideration when designing the fixture and when performing the inductance measurement. The loop inductance calculation for an embodiment of the electrical connector, such as the connector 300 of FIG. 3, may be approximated using the approach and assumptions described below in conjunction with FIGS. 8–9.

Figure 8:
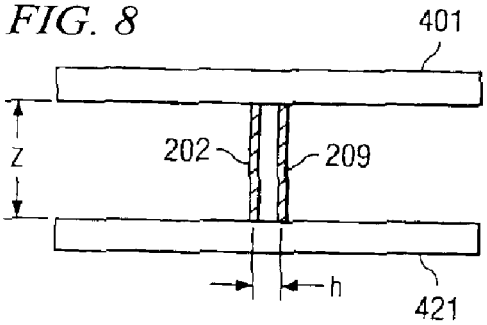
FIG. 8 shows a best-case assumption for estimating the inductance of an embodiment of the electrical connector, which is based on considering the blade as two parallel plates (or pads)

A best-case assumption is shown in FIG. 8, which is based on considering the blade as two parallel plates connecting the two boards. In FIG. 8, one blade is considered the power path and the other blade is the return path (or ground). The magnetic field cancellation is higher when the separation h is as small as possible. A higher magnetic field cancellation will cause a lower loop inductance. This explains why the choice of the two parallel blades will give the "best-case" assumption for calculating the connector loop inductance, since the blades are the closest plates in the connector (i.e., with the lowest value of h). The inductance may be calculated using the following equation: $L \approx (\mu_0 \mu_r h/w)l$, where $\mu_0$ is the permeability of free space, $\mu_r$ is the relative permeability of the blade material (e.g., copper alloy), h is the blades separation distance, w is the blade width, and l is the length of the blade (along the current flow). Using the following values: h=1.3 mm, w=7.5 mm, l=6.5 mm, and $\mu_r$=1, the loop inductance is found to be L=1.4 nH (per segment), and the example connector of FIG. 3 implemented with these values would therefore have a total loop inductance of 400 pH.

Figure 9:
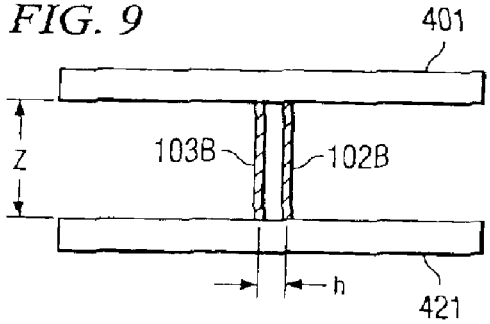
FIG. 9 shows a worst-case assumption for estimating the inductance of an embodiment of the electrical connector, which is based on considering the tines holders of the socket as two parallel plates for connecting the two boards.

A worst-case assumption is shown in FIG. 9, in which the assumption is made that a "one piece" socket contacts holders of socket 100 are two parallel plates for connecting the two boards. Using the values: h=1.6 mm, w=7.5 mm, l=7.5 mm, and $\mu_r$=1, the loop inductance is found to be L=2.0 nH (per segment), and example connector of FIG. 3 implemented with these values would therefore have a total loop inductance of 667 pH.

The above assumptions of FIGS. 8 and 9 may be used to determine a lower bound and an upper bound on the loop inductance value of the example connector of FIG. 3, wherein using the above values provides: 400 pH<L<667 pH. It should be recognized that the above loop inductance calculations are based on the implicit assumption of uniform current distribution, which is generally not the case in reality, which will in turn cause a slight increase in the lower and higher bounds of the above-estimated loop inductance.

The equivalent capacitance of an embodiment of the connector is now described. In general, as the value of h is reduced, the capacitance increases. Also, since this example embodiment uses power pads, rather than pins, the capacitance is further increased because the surface area is increased. However, the amount of capacitance yielded in this example does not significantly affect the power supply design. The power and the ground plates formed by the two parallel split pads of blade 200 may be represented by a capacitor with value that can be calculated from the following equation: $C=\epsilon_r \epsilon_0 A/h$, where $\epsilon_r$ is the relative permitivity of the insulating material, $\epsilon_0$ is the relative permitivity of free space, A is the surface area of the blade, and h is the separation between the two pads of blade 200. Assuming the following values: $\epsilon_r$=3.0, $\epsilon_0$=8.85$^{-12}$, A=(7.5 mm×6.5 mm)= 48.75 mm$^2$, and l=1.3 mm, the capacitance value C=1 pF, and the total connector capacitance for the example connector of FIG. 3 using the above values is 3 pF.

Figure 10:
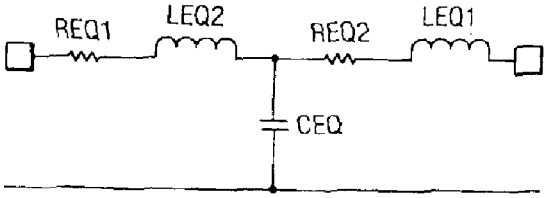
FIG. 10 shows an RLC equivalent circuit of an embodiment of the connector, such as the embodiment of FIG. 3.

The RLC equivalent circuit of an embodiment of the connector, such as that of FIG. 3, is shown in FIG. 10. For this embodiment, the capacitor value is so small that it could be removed from the equivalent circuit.

Figure 11A:
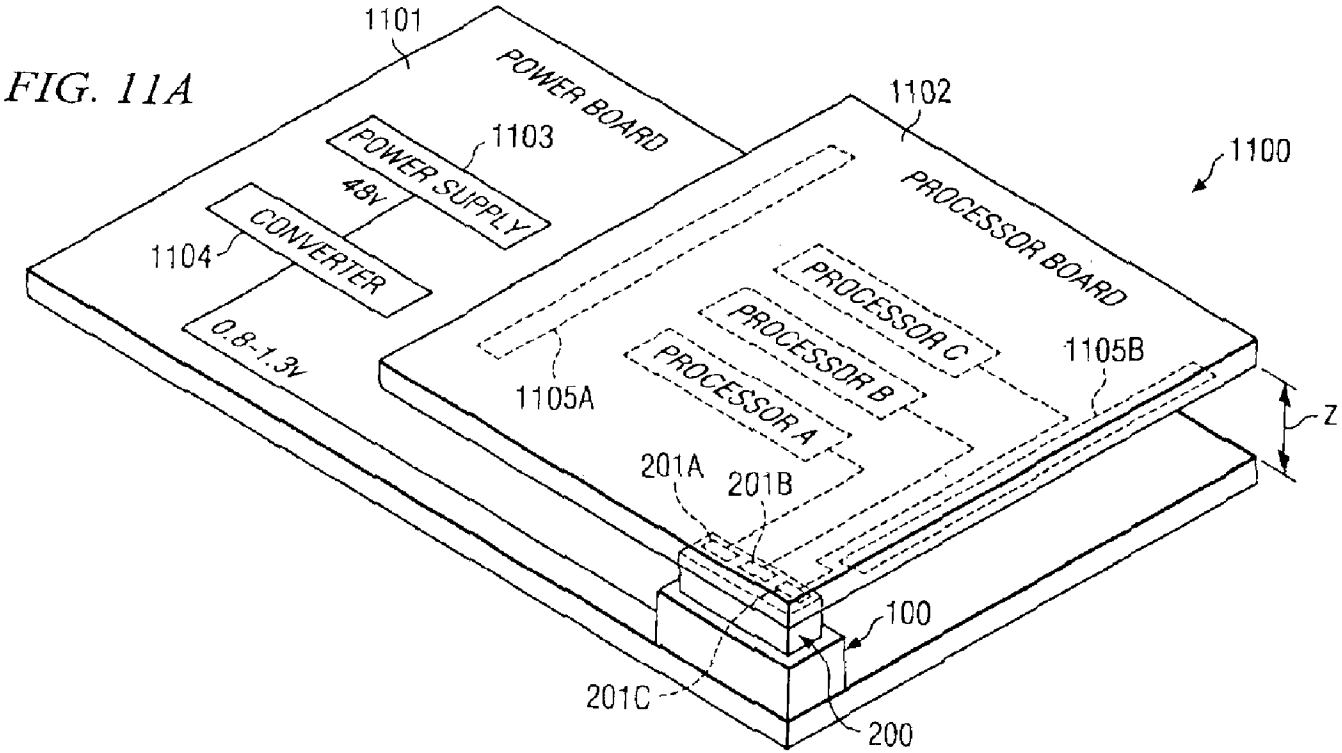
FIG. 11A shows an example system in which two circuit boards are electrically coupled together via an embodiment of an electrical connector.

FIG. 11A shows an example system 1100 in which two circuit boards are electrically coupled together via an embodiment of an electrical connector. As shown, first mating component 100 of FIGS. 1A–1B is coupled to a power board 1101, and blade 200 of FIGS. 2A–2C is coupled to a processor board 1102, whereby first mating component 100 electrically couples to blade 200 (via contact between the engagement members of mating component 100 and the pads of blade 200) such that power may be provided from power board 1101 to processor board 1102 via such coupling. More specifically, in this example, power board 1101 includes a power supply 1103 that outputs 48 Volts (V). The 48V output by power supply 1103 is received by converter 1104, which outputs a desired voltage level to be supplied to processor board 1102 (e.g., 0.8V–1.3V in this example). The power is supplied from converter 1104 to first mating portion 100, which supplies the power to second mating portion (or "blade") 200. The power is then provided from blade 200 to the components (e.g., processors) of board 1102. For instance, in this example, the power is provided from segment 201A of blade 200 to a first processor, "processor A". Similarly, the power is provided from segment 201B of blade 200 to a second processor, "processor B", and power is provided from segment 201C of blade 200 to a third processor, "processor C".

As shown in FIG. 11A, power board 1101 and processor board 1102 are positionally fixed relative to each other based on some mechanics (e.g., structural mechanisms, frames, etc.) 1105A and 1105B. Due to manufacturing tolerances, the relative distance between power board 1101 and processor board 1102 (shown as the "Z-axis" in FIG. 11) may vary (e.g., by plus or minus 30 mils in one implementation). More specifically, in one example implementation, the boards 1101 and 1102 have a target distance "X" of 7.1 mm therebetween when coupled together, but the electrical connector utilized for coupling the boards allows for a variance "D" of 30 mil such that the connector has a Wipe that covers at least 60 mil. Of course, other implementations of the connector may be utilized in accordance with the teachings herein to provide for various other desired target distances and Wipes.

In the example of FIG. 11A, relatively high current is needed to be supplied via the electrical connector (for powering processor board 1102) while permitting Z-compliance. While this arrangement utilizes the connector for conducting power from a power supply board to another board, in alternative embodiments such connector may be used to conduct data signals between the boards rather than (or in addition to) a power supply. By reducing the inductance to a suitable level, the connector inductance of certain embodiments is dwarfed by the inductance of the output inductor of the power supply. The connector of certain embodiments, such as that of FIG. 3, is so small it is effectively not seen (or is not a factor) in the transient response of the power supply. Additionally, the effect of a small inductance is a reduction in output capacitance at the load. In traditional connectors, inductance is typically sufficiently high such that capacitance was required between the power supply output inductor and the connector and even more capacitance was required at the load. With this inductance being reduced in certain embodiments of the electrical connector, such as that of FIG. 3, the capacitance between the power supply output inductor and connector may be eliminated, thus reducing the amount of components needed in the overall power connector design (i.e., the overall design of a power board for connecting to another board, such as a processor board).

Figure 11B:
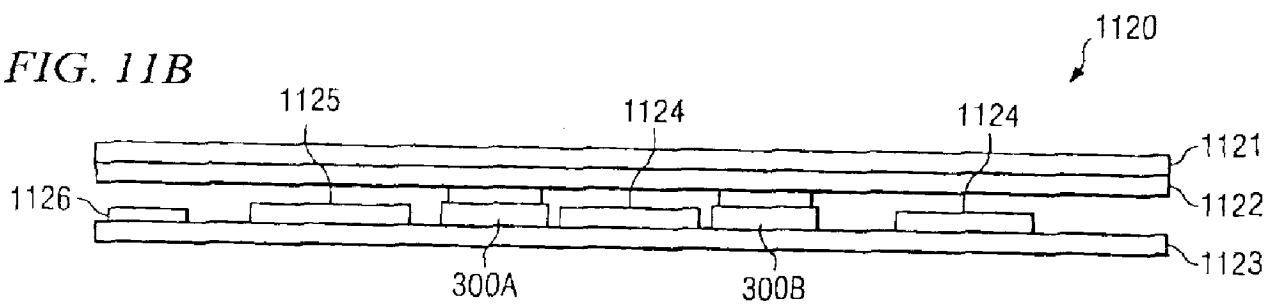
FIG. 11B shows another example system in which an embodiment of an electrical connector disclosed herein may be used for coupling two circuit boards.

FIG. 11B shows another example system 1120 in which two circuit boards are electrically coupled together via an embodiment of an electrical connector. As shown, electrical connectors 300A and 300B, which each correspond to the example electrical connector 300 of FIG. 3, are used for coupling a power board 1122 to a processor board 1123. The example system 1120 further comprises heat sink 1121. Also, processor board 1123 comprises the following components: memory 1126, application-specific integrated circuit (ASIC) 1125, and microprocessors 1124. Some or all of such components of processor board 1123 are supplied power from power board 1122 via electrical connectors 300A and 300B. As with the example of FIG. 11A, connectors 300A and 300B enable boards 1122 and 1123 to be arranged at any distance within a range of distances relative to each other. That is, the connectors provide Z-axis compliance. For instance, the connectors may have a Wipe of at least 60 mil in certain implementations. However, the connectors are capable of supporting a relatively high power load as described above.

In one embodiment, such as that described above with FIGS. 1A–4C, the connector comprises at least one segment having a current rating of 25 A per contact (i.e., 25 A current rating for the contact between the socket's engagement members and the blade's pad on one side of the blade's insulator, and a 25 A current rating for the contact between the socket's engagement members and the blade's pad on the opposite side of the blade's insulator) at a temperature rise of 30° C. or less. As in the example embodiment of FIGS. 1A–4C, the connector may comprise three segments, whereby 150 A total current rating is achieved for the connector at a temperature rise of 30° C. or less. Of course, other embodiments of the connector may be implemented to provide different current ratings as desired. In certain embodiments of the electrical connector, such as the example embodiment of FIGS. 1A–4C, the electrical connector is capable of supporting a relatively large power load that is conducted from power supply board 1122 to processor board 1123. Power is a function of voltage applied. In this example case, each blade pad is rated for 25 A continuous current. The lowest voltage expected to be applied is 0.85V; therefore, the lowest power limit would be 21.25 W. However, the highest theoretical voltage to be applied in this example would be 60V, and therefore the highest power limit would be 1,500 W. For the example three socket configuration of FIG. 3, the low end of power is approximately 63.75 W positive and 63.75 W negative and the high end of the power is approximately 4,500 W positive and 4,500 W negative. This is similar to existing connectors. However, existing connectors have higher inductance and require more volume in the design. Other embodiments of the connector may be implemented to be capable of supporting different power loads than that described above, as desired.

Figure 12:
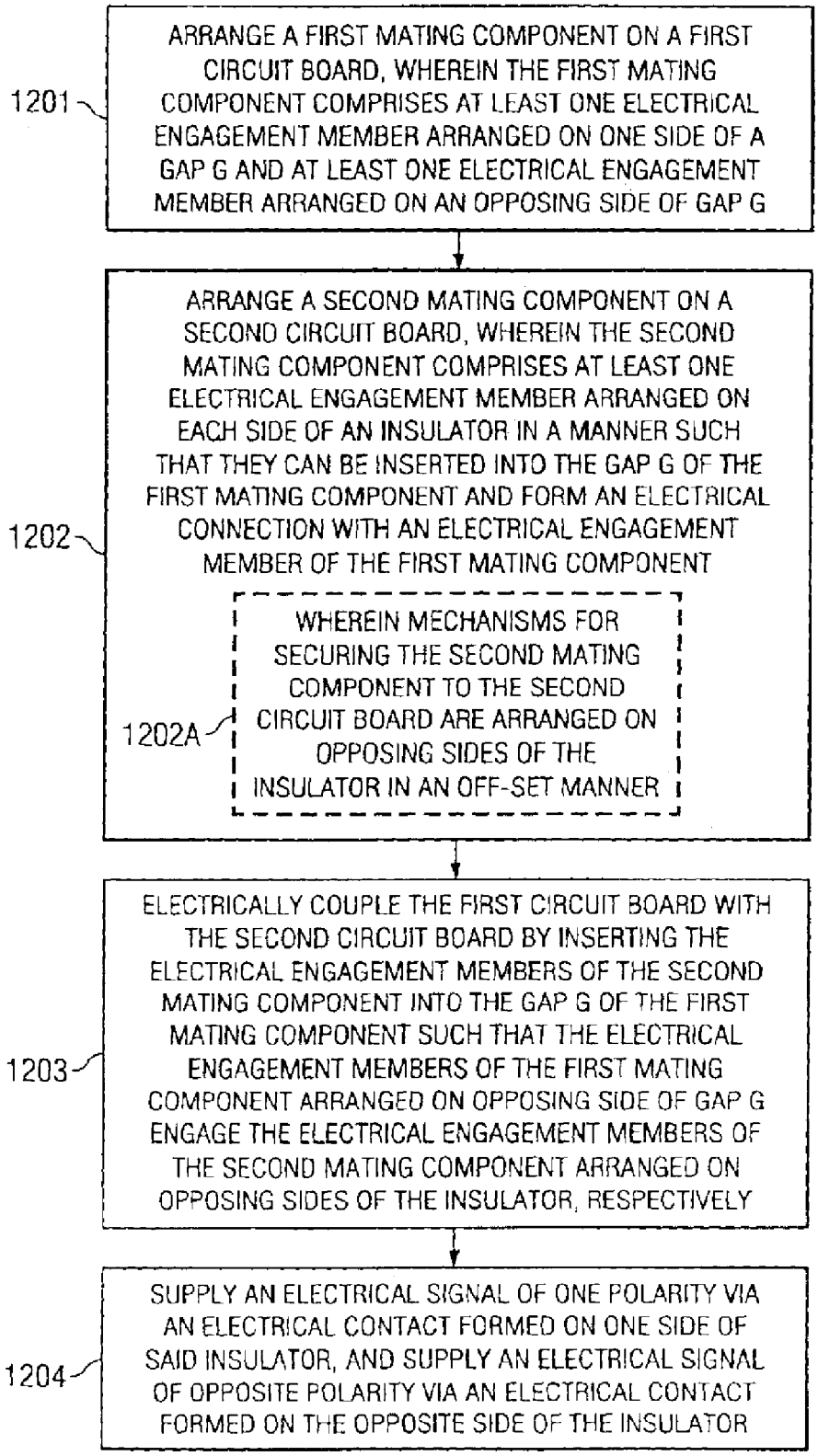
FIG. 12 shows an example operational flow diagram for using an embodiment of an electrical connector for electrically coupling two circuit boards together.

Turning to FIG. 12, an example operational flow diagram is shown for using an embodiment of an electrical connector for electrically coupling two circuit boards together. In operational block 1201 a first mating component (or "socket") is arranged on a first circuit board. As with the example mating component 100 of FIGS. 1A–1C, the first mating component comprises at least one electrical engagement member arranged on each side of a gap G (or "spatial separation"). More specifically, the first mating component comprises a gap G with at least one electrical engagement member arranged on each side thereof, wherein the electrical engagement members arranged on one side of the gap G are electrically isolated from the electrical engagement members of the opposite side of the gap G.

In operational block 1202 a second mating component is arranged on a second circuit board. As with the example mating component (or "blade") 200 of FIGS. 2A–2C, this second mating component may comprise at least one electrical engagement member (or "pad") arranged on each side of an insulator in a manner such that they can be inserted into the gap G of the first mating component and contact electrical engagement members of the first mating component. As shown in optional block 1202A, in certain embodiments the second mating component may include mechanisms for securing such second mating component to the second circuit board, wherein such mechanisms are arranged on opposing sides of the insulator in an off-set manner, such as described above with the example of FIGS. 5B–5C.

In operational block 1203, the first circuit board is electrically coupled to the second circuit board by inserting the electrical engagement members (or "pads") of the second mating component into the gap G of the first mating component such that the electrical engagement members of the first and second mating components come into contact. More specifically, the electrical engagement member(s) of the second mating component that are arranged on one side of the insulator engage the engagement member(s) of the first mating component that are arranged on one side of gap G, and the electrical engagement member(s) of the second mating component that are arranged on the opposite side of the insulator engage the engagement member(s) of the first mating component that are arranged on the opposite side of gap G, such as shown in FIGS. 3 and 4C above.

As shown in optional operational block 1204, in certain embodiments an electrical signal of one polarity is supplied from one of the first and circuit boards to the other of the first and second circuit boards via an electrical contact formed on one side of the insulator of the second mating component, and an electrical signal of another polarity is supplied from one of the first and circuit boards to the other of the first and second circuit boards via an electrical contact formed on the opposite side of the insulator of the second mating component. An example of such an embodiment is described above in conjunction with FIGS. 4A–4C.

Embodiments of an electrical connector described above are particularly useful for applications that desire/require low inductance, low resistance, compact connection (e.g., small footprint), and Z-axis compliance from an electrical connector. It should be recognized that the embodiments of an electrical connector described herein are not limited in application solely to coupling circuit boards in the manner shown herein. For instance, while many of the example FIGURES described above show coupling two circuit boards in parallel, embodiments of the electrical connector may be applied in a perpendicular card or card edge fashion. Further, the electrical connector may, in certain implementations, be a connection point between two assemblies, such as two or more mother boards. Further, while certain embodiments are described as using the electrical connector for supplying power connections, in other embodiments the electrical connector may be used for supplying data signals in addition to or instead of power connections. Additionally, while embodiments of the electrical connector have particular applicability for coupling circuit boards, the electrical connector may, in some instances, be applied for electrically coupling components other than circuit boards, particularly components that desire/require low inductance, low resistance, compact connection (e.g., small footprint), and Z-axis compliance from an electrical connector.

What is claimed is:

1. An electrical connector assembly for electrically coupling two components, said electrical connector assembly comprising:

a socket coupled to a first component, said socket having at least one segment that includes at least a first conductive engagement member arranged on a first side of a spatial gap and at least a second conductive engagement member arranged on an opposite side of said spatial gap, said second conductive engagement member being electrically isolated from said first conductive engagement member; and a blade coupled to a second component, said blade having at least one segment that includes at least a first conductive pad arranged on a first side of an insulator and at least a second conductive pad arranged on an opposite side of said insulator, wherein said second conductive pad is arranged directly opposite said first conductive pad, and said blade having a width complementary to the spatial gap of said socket such that when said blade is inserted into said spatial gap said first conductive pad of said blade forms an electrical contact with said first conductive engagement member of said socket and said second conductive pad of said blade forms an electrical contact with said second conductive engagement member of said socket, wherein said first and second conductive pads of said blade are electrically isolated from each other, and wherein said blade comprises first connector mechanisms for electrically coupling said first conductive pad to said second component and second connector mechanisms for electrically coupling said second conductive pad to said second component, wherein said first and second connector mechanisms are off-set from each other.

2. The electrical connector assembly of claim 1 wherein electrical contact is achievable between the first and second engagement members of said socket and the first and second conductive pads of said blade over a range of distances at which said first and second components may be arranged relative to each other.

3. The electrical connector assembly of claim 1 wherein electrical connection is achievable between the first and second engagement members of said socket and the first and second conductive pads of said blade over a range of insertion distances by which said blade is inserted into the spatial gap of said socket.

4. The electrical connector assembly of claim 1 comprising a wipe of at least 60 mil.

5. The electrical connector assembly of claim 1 wherein said width of said blade is approximately 1.5 mm.

6. The electrical connector assembly of claim 1 wherein said first connector mechanisms comprises pins on one side of said insulator that electrically couple the first conductive pad of the blade to said second component, and said second connector mechanisms comprises pins on a side of said insulator opposite said one side that electrically couple the second conductive pad of the blade to said second component, and wherein none of the pins of the first connector mechanisms are arranged directly across from any of the pins of the second connector mechanisms.

7. The electrical connector assembly of claim 1 wherein said at least one segment of said socket and blade have a current rating of approximately 25 A per electrical contact.

8. The electrical connector assembly of claim 1 wherein said socket and blade each have a plurality of said segments.

9. The electrical connector assembly of claim 8 wherein said plurality of segments of said blade are electrically isolated from each other and said plurality of segments of said socket are electrically isolated from each other.

10. The electrical connector assembly of claim 1 wherein said first and second components are circuit boards.

11. The electrical connector assembly of claim 10 wherein one of said first and second components comprises a power board having a power supply for supplying power to the other of said first and second components, and wherein said power is supplied from said power board to said other component via said electrical connector assembly.

12. The electrical connector assembly of claim 11 wherein said socket and said blade each comprises at least three of said segments, and wherein connector comprises a total current rating of at least 150 A.

13. An electrical connector assembly of for electrically coupling two components, said electrical connector assembly comprising:

a socket coupled to a first component, said socket having at least one segment that includes at least a first conductive engagement member arranged on a first side of a spatial gap and at least a second conductive engagement member arranged on an opposite side of said spatial gap, said second conductive engagement member being electrically isolated from said first conductive engagement member; and a blade coupled to a second component, said blade having at least one segment that includes at least a first conductive pad arranged on a first side of an insulator and at least a second conductive pad arranged on an opposite side of said insulator, and said blade having a width complementary to the spatial gap of said socket such that when said blade is inserted into said spatial gap said first conductive pad of said blade forms an electrical contact with said first conductive engagement member of said socket and said second conductive pad of said blade forms an electrical contact with said second conductive engagement member of said socket, wherein said first and second conductive pads of said blade are electrically isolated from each other, and wherein said blade comprises first connector mechanisms for electrically coupling said first conductive pad to said second component and second connector mechanisms for electrically coupling said second conductive pad to said second component, wherein said first and second connector mechanisms are off-set from each other;

wherein said at least one segment of said socket comprises a plurality of said conductive engagement members for engaging a common conductive pad of said blade.

14. A system comprising:

a power supply board;

a circuit board comprising components to be powered at least partially by said power supply board;

an electrical connector for electrically coupling said power supply board with said circuit board for supplying power from the power supply board to said circuit board via said electrical connector, said electrical connector comprising (a) a socket coupled to one of said power supply board and said circuit board, said socket having at least one segment that includes at least a first conductive engagement member arranged on a first side of a spatial gap and at least a second conductive engagement member arranged on an opposite side of said spatial gap, said second conductive engagement member being electrically isolated from said first conductive engagement member; and (b) a blade coupled to the other of said power supply board and said circuit board, said blade having at least one segment that includes at least a first conductive pad arranged on a first side of an insulator and at least a second conductive pad arranged on an opposite side of said insulator, and said blade having a width complementary to the spatial gap of said socket such that when said blade is inserted into said spatial gap said first conductive pad of said blade forms an electrical contact with said first conductive engagement member of said socket and said second conductive pad of said blade forms an electrical contact with said second conductive engagement member of said socket, wherein said first and second conductive pads of said blade are electrically isolated from each other;

wherein said power supply board supplies electrical power to said circuit board via said electrical connector by conducting electrical signals of one polarity via said electrical contact between said first conductive engagement member of said socket and said first conductive pad of said blade and by conducting electrical signals of a polarity opposite said one polarity via said electrical contact between said second conductive engagement member of said socket and said second conductive pad of said blade.

15. The system of claim 14 wherein electrical contact is achievable between the first and second engagement members of said socket and the first and second conductive pads of said blade over a range of distances at which said power supply board and said circuit board may be arranged relative to each other.

16. The system of claim 14 wherein electrical connection is achievable between the first and second engagement members of said socket and the first and second conductive pads of said blade over a range of insertion distances by which said blade is inserted into the spatial gap of said socket.

17. The system of claim 14 wherein said electrical connector comprises a wipe of at least 60 mil.

18. The system of claim 14 wherein said width of said blade is no more than 3.5 mm.

19. The system of claim 14 wherein said blade comprises first connector mechanisms for electrically coupling said first conductive pad to said other of said power supply board and said circuit board and second connector mechanisms for electrically coupling said second conductive pad to said other of said power supply board and said circuit board, and wherein said first and second connector mechanisms are off-set from each other.

20. The system of claim 14 wherein said blade comprises pins on each side of said insulator that electrically couple the first and second conductive pads of the blade to said other of said power supply board and said circuit board, wherein none of the pins on one side of the insulator are arranged directly across from any of the pins on the opposite side of the insulator.

21. A method of electrically coupling two circuit boards, said method comprising:

electrically coupling a blade to a first circuit board via a first connector mechanism that electrically couples a first conductive pad of said blade to said first circuit board and a second connector mechanism that electrically couples a second conductive pad of said blade to said first circuit board, wherein said first and second connector mechanisms are off-set from each other;

inserting said blade that is coupled to said first circuit board within a spatial gap of a socket that is coupled to a second circuit board such that said first conductive pad and said second conductive pad of said blade that are arranged directly opposite each other on opposing sides of an insulator and that are electrically isolated from each other engage at least a first conductive member and a second conductive member, respectively, of said socket that are arranged on opposite sides of said spatial gap of said socket and that are electrically isolated from each other;

conducting electrical signals of one polarity from one of the first and second circuit boards to the other of the first and second circuit boards via the engagement of the first conductive pad and the first conductive member; and conducting electrical signals of a polarity opposite said one polarity from one of the first and second circuit boards to the other of the first and second circuit boards via the engagement of the second conductive pad and the second conductive member.

22. The method of claim 21 wherein one of said first and second circuit boards comprises a power board having a power supply for supplying power to the other said first and second circuit boards, wherein said conducting electrical signals comprises:

supplying power from said power board to said other circuit board.

23. The method of claim 22 wherein said supplying power comprises:

supplying at least 25 A positive and 25 A negative.

24. The method of claim 22 wherein said supplying power comprises:

supplying at least 75 A positive and 75 A negative.

25. The method of claim 21 wherein said inserting comprises:

inserting said blade by any amount within a range of insertion distances, wherein said first conductive pad and a second conductive pad of said blade make electrical contact with said at least a first conductive member and a second conductive member, respectively, at any insertion amount within said range of insertion distances.

26. The method of claim 25 wherein said range of insertion distances comprises a range of at least 60 mil.

* * * * *

UNITED STATES PATENT AND TRADEMARK OFFICE

CERTIFICATE OF CORRECTION

PATENT NO. : 6,969,261 B2
APPLICATION NO. : 10/632422
DATED : November 29, 2005
INVENTOR(S) : Shaun L. Harris et al.

It is certified that error appears in the above-identified patent and that said Letters Patent is hereby corrected as shown below:

In column 20, line 5, in Claim 13, after “assembly” delete “of”.

Signed and Sealed this

Fourth Day of August, 2009

JOHN DOLL
*Acting Director of the United States Patent and Trademark Office*